US010003878B2

(12) United States Patent
Ushakov

(10) Patent No.: US 10,003,878 B2
(45) **Date of Patent: *Jun. 19, 2018**

(54) IN-THE-EAR EARPHONE, ITS VARIATIONS AND METHODS OF WEARING THE EARPHONE

(71) Applicant: Alexey Leonidovich Ushakov, Moscow (RU)

(72) Inventor: Alexey Leonidovich Ushakov, Moscow (RU)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/386,132

(22) Filed: Dec. 21, 2016

(65) Prior Publication Data

US 2017/0099537 A1 Apr. 6, 2017

Related U.S. Application Data

(63) Continuation-in-part of application No. 14/632,459, filed on Feb. 26, 2015, now Pat. No. 9,584,897.

(30) Foreign Application Priority Data

Aug. 15, 2014 (RU) ..... 2014133659

(51) Int. Cl.
*H04R 25/00* (2006.01)
*H04R 1/10* (2006.01)
*H04R 31/00* (2006.01)

(52) U.S. Cl.
CPC ..... *H04R 1/1016* (2013.01); *H04R 1/105* (2013.01); *H04R 1/1066* (2013.01); *H04R 31/006* (2013.01)

(58) Field of Classification Search
CPC ..... H04R 1/105; H04R 1/1016
See application file for complete search history.

(56) References Cited

U.S. PATENT DOCUMENTS 5,881,161 A * 3/1999 Liu ..... H04R 1/105 381/370
6,047,076 A * 4/2000 Yang ..... H04R 1/1066 181/129
6,418,230 B1 * 7/2002 McDonald ..... H04R 1/10 379/426
8,103,040 B2 * 1/2012 Pelland ..... H04R 1/1016 381/374

(Continued)

*Primary Examiner* — Matthew Eason
*Assistant Examiner* — Ryan Robinson
(74) *Attorney, Agent, or Firm* — Bardmesser Law Group

(57) ABSTRACT

An earphone includes an acoustic housing including an electroacoustic transducer and an opening, a wire connected to the electroacoustic transducer, a mounting part coupled to the acoustic housing through a cylindrical hinge and having a rotatable wire guide, and a bendable element connected to the mounting part near an axis of rotation of the wire guide. The wire is connected to the wire guide. The sound opening is opposite the axis of rotation. The bendable element and an outer portion of the wire guide in a first orientation are in the same plane as the axis of rotation and oriented in a generally opposite direction from the axis of rotation. The outer portion of the wire guide is oriented towards the sound opening. The outer portion of the wire guide and the bendable element are movable through at least 50 degrees from the first to a second orientation.

34 Claims, 20 Drawing Sheets

(56) References Cited

U.S. PATENT DOCUMENTS

| | | | | |
|---|---|---|---|---|
| 8,116,502 | B2 * | 2/2012 | Saggio, Jr. ..... | H04R 1/1016<br>381/328 |
| 8,194,911 | B2 * | 6/2012 | Dyer ..... | H04R 1/1016<br>181/135 |
| 2007/0223765 | A1 * | 9/2007 | Wang ..... | H04R 1/1066<br>381/374 |
| 2012/0116231 | A1 * | 5/2012 | Liao ..... | H04R 1/1016<br>600/473 |

* cited by examiner

IN-THE-EAR EARPHONE, ITS VARIATIONS AND METHODS OF WEARING THE EARPHONE

FIELD OF THE INVENTION

The present invention relates to the field of acoustics, in particular to earphones, and more particularly to adjustable in-ear earphones.

BACKGROUND OF THE RELATED ART

Earphones placed inside the ear, according to the type of embodiment are divided into two types:

earbuds or plug-in earphones;

in-ear-canalphones or IEMs (In-Ear-Monitors).

Earbuds (inserted)—earphones are inserted into the ear and held there by the resilience force. Earphones of this type do not completely plug the external auditory canal and are placed next to it, directing the sound waves in the direction of the external auditory canal. The disadvantages of this type of earphone may include:

poor sound insulation from ambient noise;

due to the fact that they do not completely cover the external auditory canal, audio quality is significantly degraded;

weakly bound inside the ear if not provided with additional devices to hold it in place.

But earbuds have certain advantages: they do not irritate the pressure-sensitive surface of the membranous-cartilaginous (front) of the external auditory canal and allow hearing surrounding sounds.

In-ear-canalphones (in various sources, also called vacuum earphones, plugs, ear monitors, in English sources as IEMs)—are worn completely plug the ear canal, providing good insulation against ambient noise.

Compared with earbuds they have a number of tangible advantages:

provide high-quality sound;

in-ear-canalphones—IEM stay in the ear relatively well, since they quite tightly and deeply enter into the external auditory canal.

The disadvantages of this type of earphones include:

unpleasant and painful sensations during long-term wear, since they strongly pressure on the most sensitive area of the outer ear—the front part of the membranous-cartilaginous portion of the external auditory canal;

ear opening is earphone-plugged, and consequently, it is difficult to outflow from the sebaceous and sulfur glands located in the membranous-cartilaginous portion of the external auditory canal;

due to the relatively good passive noise-isolation, hearing of ambient sounds is difficult;

increases the load on the hearing aid during prolonged listening at high volume levels that can cause hearing loss.

In some constructive solutions, earbuds are supplied with a directed-into-the ear canal pin with a soft sealing ear cushion. This increases the useful volume of the earphones through the use of internal volume of the ear, not just the ear canal. However, such earphones have all the disadvantages of in-ear-canalphones.

A known custom headset for placement in the ear (US Application Publication No. 2011/0135120 A1), consists of a housing containing a near and remote part, where a remote part has a built-in speaker, and is formed for accommodation in the ear canal of the user. Also, a remote part includes a projection for its seal in the ear canal. This headset has no moving parts, and thus does not give an opportunity to adjust the earpiece in the ear of the user, and does not combine the features of in-ear-canalphones and earbuds.

A known earphone (U.S. Pat. No. 8,265,328) consists of an ear hook, a shaft attached to the end of the ear hook, a housing for an electro-acoustic transducer, a tube allowing the body to move along the shaft, and also includes a cable connected to the electroacoustic transducer and extending inside the ear hook, shaft and housing. This earphone design allows for a minor adjustment of the position of the earphone inside the ear, but only earbuds can be used. Despite the fact that the sliding of the shaft is provided in the tube attached to the earpiece, movement is only possible in the longitudinal axis direction, without rotation. This earphone is rather cumbersome and hook-shaped, which may lead to the engagement of the clothes or wire during an inoperative state. It complicates the use of the earphones in conjunction with other equipment, such as goggles, helmets etc.

A known ear loop for earphone (U.S. Pat. No. 8,320,603), like the previously considered earphones, has a shaft inserted in the ear hook tube that enables adjustment of the earphone inside the ear. This design has the same disadvantages as the previous earphone, and is itself a plug-in with some characteristics of a particular type of earphone, which excludes its transformation into an intra-canal earphone.

A known earphone adapter (U.S. Pat. No. 8,472,660) is intended for earbuds. It comprises a BTE (Behind The Ear) earhook with the option of movable placement of earphone on it, allowing adjustment of earphone. The disadvantages of this adapter is the fact that only earbuds can be used, since the mobility of the earphone on the earhook axis doesn't allow placement of the earphone in an intra-cannel position, i.e., to transform earphone from the earbud into in-ear-canalphones. In addition, when wearing the earhook covers the ear from the outside almost completely, due to which the entire structure is large and has a pronounced hook shape. This adapter has the inherent disadvantages of the two previously considered devices.

A known earbud type of earphone having auricular fastening (U.S. Pat. No. 5,729,615) has the rod rigidly attached to the earphone acoustic elements, where the rod enters into the bushing, a continuation of which is a BTE earhook of earphone. The acoustic element can be rotated relative to the bushing-earhook and vertically lifted or lowered by sliding the rod inside the bushing. The disadvantage is a limited number of adjustments intended for selecting only one relatively comfortable position with the acoustic element in the auricle when using earphones for different people with different anthropometric data. Moreover, an integral fixture of this type of earphone is a massive BTE earhook, increasing the size, complicating form and increasing the number of clinging hook-shaped members in the earphone.

A known device of the earphones with a stabilizer (U.S. Pat. No. 8,374,375) comprises a housing and a flexible member to stabilize the earphone when wearing it by abutting the wall of the ear. The flexible element has two stable positions relative to the housing and respectively earphone can have two positions in the auricle. But in this device change in position of earphone in the ear does not lead to the possibility of its transformation from earbud into in-ear-canalphones.

A known acoustic device with the adaptation for placement in a human ear (U.S. Pat. No. 7,068,803) is an earphone with a spring in the form of a flexible rod, which holds the earphone in the ear of the user, located in a bent state along the wall of the ear. This device provides secure fit of the earphone in the auricle in the only possible position, not allowing adjustment of the earphone or its transformation.

A known hearing aid with a flexible elongate member (U.S. Pat. No. 8,374,367) is made in the form of earbuds, containing a microphone, processor, headset, battery and a flexible elongated portion, one end of which is attached to the housing, and the other is free. When the flexible elongate portion is placed in the user is auricle, the free end is located inside the auricle and outside the ear canal. As with the previous device, a hearing aid is retained in the auricle due to the resilience of the elongated member that enables to secure the unit in the only position.

A known retaining element for micro-earphone for use in hearing aids (U.S. Pat. No. 7,590,255) has in-ear-canal-phones provided with elongate resilient member for support on the internal parts of the auricle, where the aggregate resilience of the tissues of the auricle and the elongate member promotes fixation of the earbud in the ear canal, preventing its loss during wear. This element is designed only for hearing aids and also provides for the use of earphone in a simple position, eliminating the possibility of transformation earphone from in-ear-canalphones into earbuds.

A known universal hearing aid (U.S. Pat. No. 7,899,200) also comprises an elongated resilient part to fix the earphone in the user auricle. This unit has the inherent disadvantages of the two previously considered devices.

The general disadvantage of most of the considered earphone devices can also be attributed use of design solutions with ear cushions made of soft material (rubber, foam, rubber foam) for adaptation and fitting of earphone in the ear canal of the user. But soft materials become easily contaminated with dust or earwax, are poorly cleanable and therefore can easily become unhygienic.

Thus, to date there are no in the ear earphones that allow full use of the benefits of design solutions for earbuds and in-ear-canalphones—IEM (In Ear Monitor), depending on current requirements of the user when worn.

SUMMARY OF INVENTION

The object of the present invention to provide earphones having advantages of earbuds and simultaneously in-ear-canalphones, but without the drawbacks inherent to each type, that is, the earphones should be securely kept in-ear during wear, but their position could be changed, that is, the earphones must have two fixed positions; the first position—intra-channel, the second position—in the auricle, without taking the entire ear canal and allowing the user to hear surrounding sounds. Such earphones allow, depending on the environment and requirements of the user, to provide passive noise reduction or to control the sound environment around user.

The problem is solved by creating an in-the-ear earphone that can be worn in two positions, comprising an acoustic housing which includes at least one electroacoustic transducer and at least one sound opening. Also the earphone comprises a wire connected to the electroacoustic transducer, a mounting part coupled to the acoustic housing through a cylindrical hinge and having a rotatable wire guide, a bendable element connected to the mounting part near an axis of rotation of the wire guide, wherein the wire is connected to the wire guide. The sound opening is located at an end of the acoustic housing, opposing the axis of rotation of the wire guide. The bendable element and an outer portion of the wire guide in a first orientation are located substantially in the same plane as the axis of rotation of the wire guide and oriented in a generally opposite direction from the axis of rotation of the wire guide, and the outer portion of the wire guide is oriented substantially towards the sound opening, and the outer portion of the wire guide and an end of the bendable element are movable through at least 50 degrees from the first orientation to a second orientation.

Preferably, when the earphone is worn in the first orientation, the acoustic housing is located in a cavity of the auricle between a tragus and an anti-tragus, the sound opening is near an entrance of an external auditory canal, and the bendable element abuts a lower leg of an antihelix. The acoustic housing when worn in the second orientation is at least partially placed within the external auditory canal, wherein the sound opening is recessed into an external auditory canal, and the bendable element is located in a cavity of the auricle behind an anti-tragus, the outer portion of the wire guide, when worn in either the first or second orientation, is placed at a top clipping of an auricle between a leg curl and an upper-tragus tubercle, wherein, a place of connection of the wire and the outer portion of the wire guide is on a surface of a front ligament of the auricle, wherein the wire goes around an ear from a top of the ear.

In some embodiments, the bendable element has a first end connected to the mounting part. The wire guide may be a hollow shaft and the wire going inside the wire guide.

The earphone may further comprise a protective grille, a return mechanism, an electric socket, an embouchure, at least one microphone, at least one latch, adapted to hold the wire guide. The wire guide and the bendable element may be movable through at least 50 degrees in either direction from the first orientation, so the earphone can be worn in either ear. The wire guide may be adapted for longitudinal movement in the cylindrical hinge.

The bendable element may be detachable, be formed as a loop, have an adjustable length. The bendable element may further comprise a longitudinal thread, a central portion of the bendable element may be more rigid than end portions of the bendable element.

The bendable element may be connected to the wire guide. The bendable element and the wire guide may be separately movable through at least 50 degrees. The wire guide may be fixed.

The mounting part may include at least two shaft bearings and the first end of the bendable element connected to the mounting part between the shaft bearings.

Also, the objective is solved by providing a method of wearing the in-ear-earphones comprising an acoustic housing having an electroacoustic transducer and a sound opening, a wire electrically connected to the electroacoustic transducer, a mounting part coupled to the acoustic housing and having a wire guide and the wire is coupled to the wire guide. Also the earphone comprises a bendable element connected to the mounting part, wherein the bendable element is movable through at least 50 degrees.

To arrange the earphone in a first orientation, a user puts the acoustic housing in a cavity of an auricle between a tragus and an anti-tragus, places the sound opening near an entrance of an external auditory canal, and abuts a second end of the bendable element to a lower leg of an antihelix, such that the bendable element, the wire guide and the sound opening are located substantially in a common plane.

To arrange the earphone in a second orientation, the user moves an end of the bendable element through at least 50 degrees, puts the acoustic housing inside the external auditory canal, and arranges the sound opening inside of the external auditory canal.

When the earphone is worn in either the first or second orientation, the wire guide is located at a top clipping of the auricle between a leg curl and an upper-tragus tubercle, a coupling of the wire and the wire guide is located on a surface of a front ligament of the auricle, and the wire is placed around an ear from a top of the ear.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
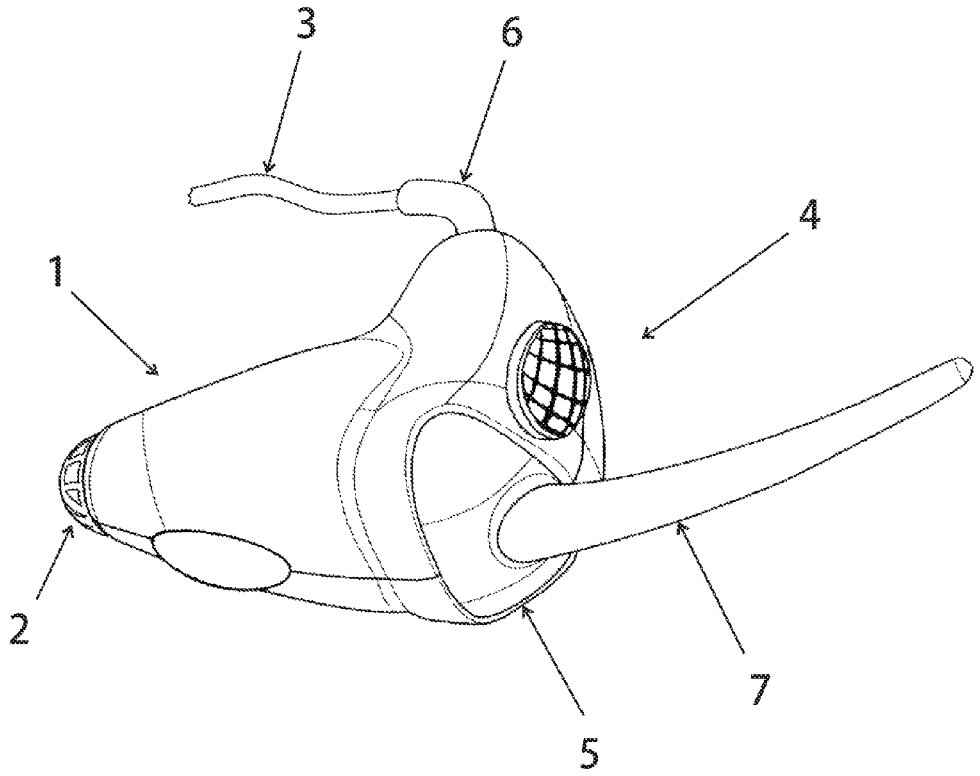
FIG. 1 is a perspective view of the earphone according to the invention.

The terms and expressions used in this text, give the following meaning, which may differ from generally accepted meanings.

In-ear earphone—a device for personal listening to music, speech or other audio signals adapted to be located within the outer ear of the user.

Electroacoustic transducer—an electromagnetic energy wave converter into an acoustic wave (dynamic or reinforcing acoustic emitter).

Wire—a linear flexible electric conductor, containing one or more twisted or adjacent, isolated or non-isolated interconnected conductors, wires or individual cables, with the insulation over them or without insulation.

Terms such as "front", "rear", "right", "left", "upper", "lower" and their derivatives represent the position of parts of the earphone or earphone itself, taken with respect to the user's head, being in an upright position and looking straight and forward.

When wearing earbuds, a user may experience some difficulties when they are loosely inserted into the auditory canal, as earphones spontaneously fall out of the ear. Some manufacturers try to solve this by placing on the earpiece extra soft and flexible stops (soft springs), abutting against the antihelix or lower leg of the antihelix. In order that the devices not irritate or pressure sensitive parts of the ear, it is required to select the least sensitive parts of the ear which will be pressured by bendable elements of the earphone and distribute the pressure over a larger area. As an example, consider two options of chuckles of the glasses—the so-called "children's" glasses with semi-rounded spring temples resiliently covering the conchae from outside and the rear. This option is present in cheaper models of glasses, and long wearing often causes discomfort, as the conchae is very sensitive in these points of contact with temples, on the inside or on the outside (although with short-term use, discomfort could not be even noticed). Expensive glasses are held with minimal discomfort without squeezing the ear only because temples resiliently semi-cover the human skull, as places of semi-coverage on the skull having much less tactile sensitivity.

When designing earphones for permanent (long-term) use, structure, innervation and blood supply to the concha of human ear should be considered, so as not to cause long-term irritation and oppressive effects on the most sensitive areas of the ear.

Blood supply to the ear is carried out through the posterior auricular artery, the superficial temporal artery and branches of the internal maxillary artery. Blood from the auricle enters the superficial temporal and posterior auricular veins that usually go along with the arteries.

Innervation of the auricle is carried out by a great auricular nerve, small occipital nerve, trigeminal nerve, nerve endings mixed branches of the vagus, glossopharyngeal and facial nerves.

Thus, in view of a detailed study of schematics of nerves and blood vessels, with a high degree of probability, the least sensitive to prolonged tactile mechanical stress is a portion the auricle at the junction of the ear cavity to the back side of anti-tragus. It is in the lower part of the ear cavity where the main body weight of the earphone should be placed in the auricle with a negligible impact on the tragus—lower part of the antihelix (front-back), and the inside of the anti-tragus—ear cavity (laterally).

The second support point (from which comes out the earphone wire) may be the edge of the temporal bone, slightly above and over the tragus hump, already outside the auricle. This place is the least sensitive because it is no longer the auricle, here there is an extensive insensitive connective tissue zone—ligamentum auriculare anterius (ligament of the auricle front), and all the nerves and arteries pass under this ligament, and, therefore, the surface of the ligamentum auriculare anterius is insensitive to the prolonged pressure.

Accordingly, a solution to these problems is desired.

Figure 2:
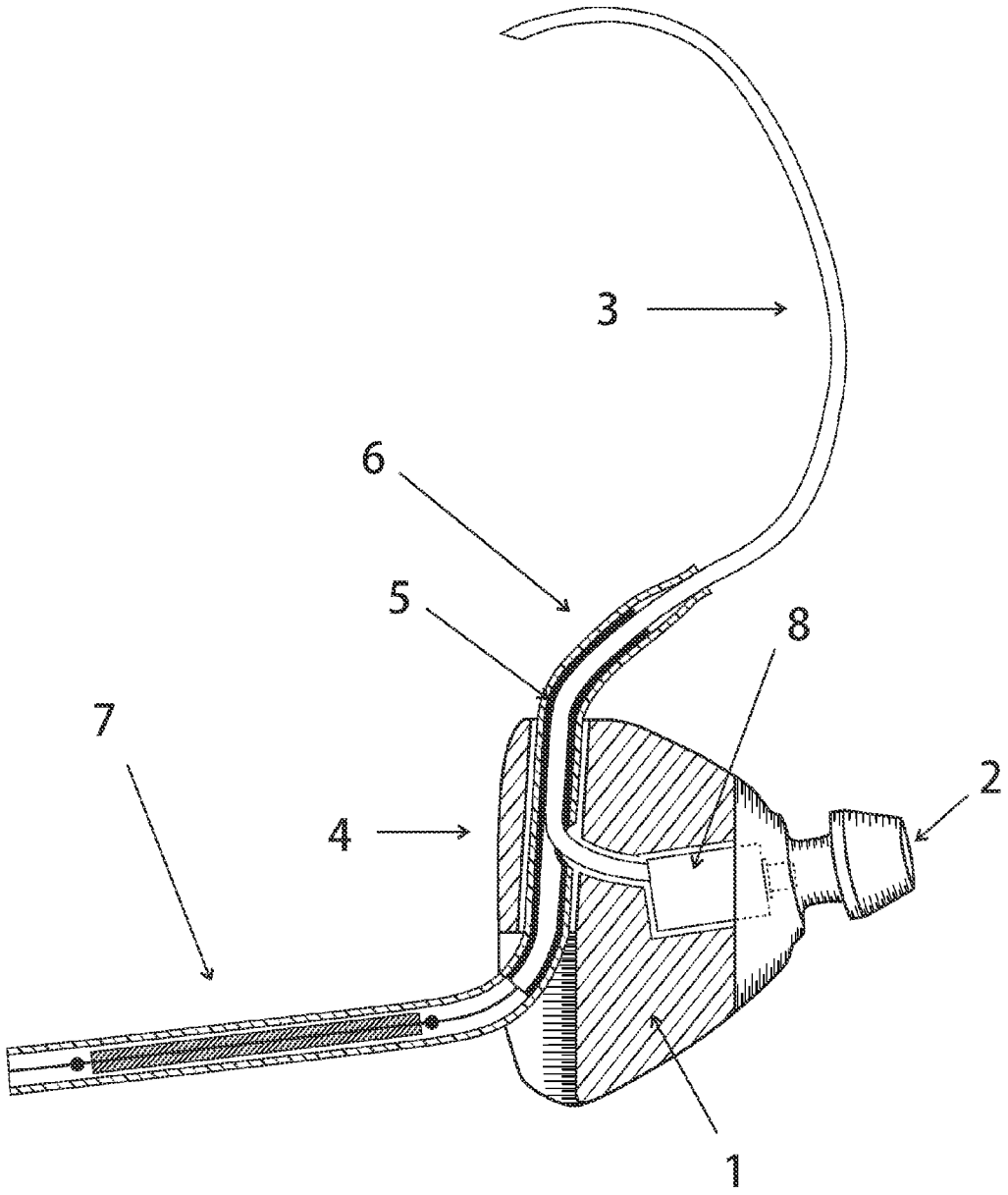
FIG. 2 shows a sectional view of the earphone in one embodiment showing the main functional elements of the invention.

We offer a new constructive solution for earphone illustrated in FIGS. 1, 2, which includes an acoustic housing 1 with a sound opening 2, a wire 3, a mounting part 4, a hinge 5, a rotatable wire guide 6, and a bendable element 7. FIG. 1 shows an embodiment with a rigidly rotating hinge.

An in-the-ear earphone (FIG. 2) to be worn in two positions, includes an acoustic housing 1 with an electroacoustic transducer 8 and a sound opening 2, a wire 3, a mounting part 4, coupled to the acoustic housing 1 through a cylindrical hinge 5 and having a rotatable wire guide 6. Also the earphone comprises a bendable element 7 connected to the mounting part 4. The outer portion of the wire guide and an end of the bendable element are movable through at least 50 degrees.

Earphone design includes their use by the user in two positions. In position "quality" most of the earphone is placed inside the user's auditory canal, the sound opening 2 is deep within the auditory canal, and the acoustic housing 1 is maximally circumferentially adjacent to the walls of the external auditory canal and clogs it. In the "comfort" position earphone placed in the auricle without inside penetration of the user's auditory canal, and the sound opening 2 is located near the entrance to the auditory canal. This is necessary to provide a reliable fastening of earphones when worn by the user in both positions.

The proposed design of the headset includes the bendable element 7 in the form of a bendable rod of rounded or polygonal cross-section, which is attached at one end to the mechanical part 4. Its purpose is in fixing the earphone in the auricle, which is especially important in the headset "comfort" mode. The prior art discloses the bendable elements used as a spring spacers between the headset, set in the external auditory meatus, and antihelix wall, and fixing the earphone housing in the auricle by forces directed forward of the tragus and back toward the anti-tragus (e.g., an example of a bendable element is known from U.S. Pat. No. 7,068,803). But in this case, fastening the earphone is only achieved by narrowly directed effect of two outward forces pressing earphone housing to tragus and the end of the bendable element to the anti-tragus. Such a local area of application of force can cause pain and is not conducive for lengthy wearing of earphones.

In the present application the earphone bendable element has a much greater length and when placing earphone in the auricle bendable element is directed substantially upwards, causing it to bend, having a smaller than the shorter bendable elements curvature radius r. Moment of bendable forces M at bending point is defined as: M=EJ/r, where E—Young's modulus, J—cross-section moment of inertia. The formula shows that by using a more flexible materials by increasing the length of the flexible member and, as a consequence, reducing the radius of curvature r, possible to create sufficient moment M to secure the earphone, and more bendable materials when bending deformation make efficient use of the element compression for redistribution of the fixing force over the entire length of the element. For this purpose, it is necessary to lean or to fix against the upper inner wall of the antihelix.

Figure 3:
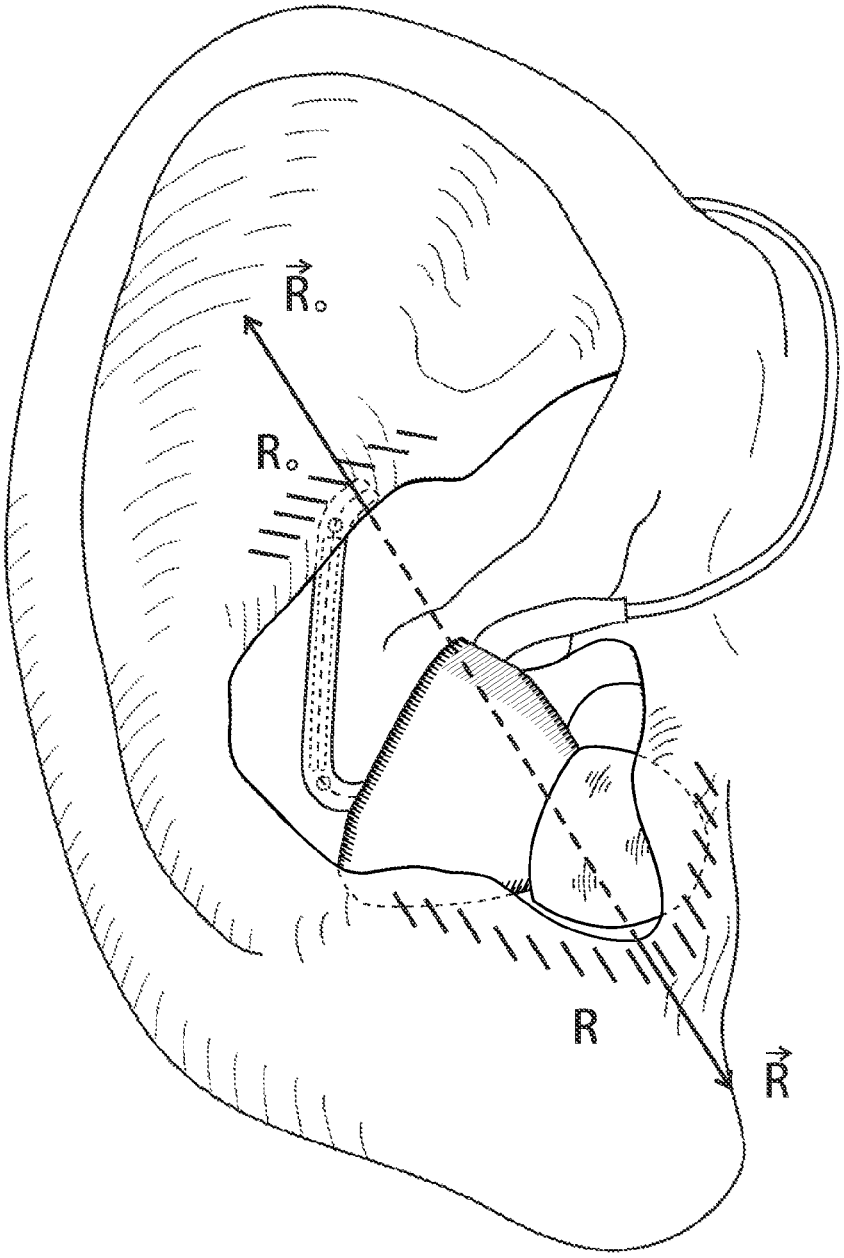
FIG. 3 shows the earphone in the ear in the "comfort" position displaying the force vectors.

FIG. 3 illustrates an earphone in the ear in the "comfort" position displaying the vectors of deformation force. These forces and deformation $\vec{R}$ and $\vec{R}_0$, compressing the arc of the bendable element 7, will be directed not only forward to the tragus but also have a vertical projection. These forces have a large application area and distribute the pressure along the lower surface of the headset on the area at the lower part of the cavity of the auricle (area $R_0$ is shown by shading) and along the inner wall of the antihelix (area R is shown by shading), which, in turn, will contribute to lower the pressure force per unit area, which leads to a reduction in discomfort when wearing.

An additional factor that serves to secure the headset is a frictional force that occurs along the entire length of the bendable element.

Figure 4:
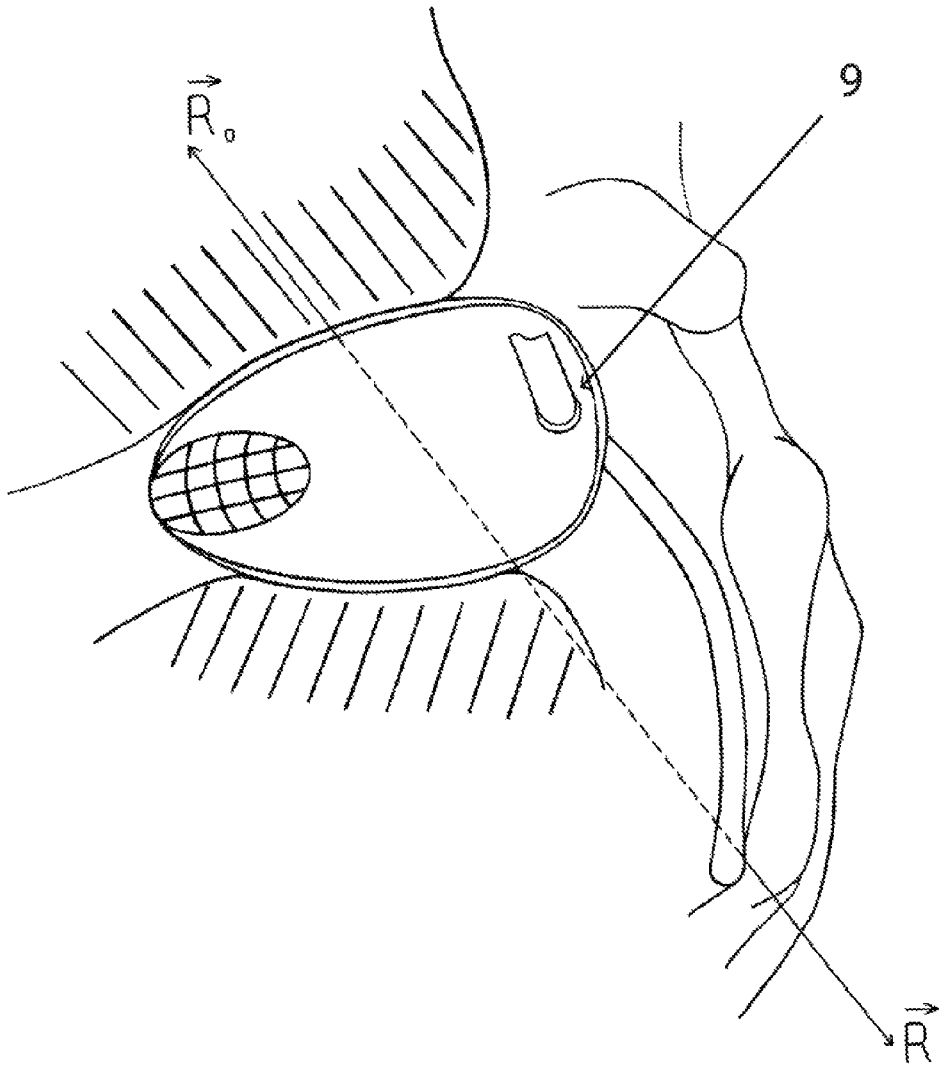
FIG. 4 shows the earphone in the ear in the "quality" position displaying the force vectors.

FIG. 4 shows a top view of the earphone, placed in a user's ear (in cross section) in the "quality" position displaying vectors of forces affecting the earpiece. Return mechanism 9 of the cylindrical hinge seeking to return the rotating wire guide to a position when an outer portion of wire guide 6 is directed towards the sound opening 2, and together with the deformable bendable element 7 results in a force $\vec{R}$, which abuts the bendable element 7 to the inner surface of the anti-tragus and a force $\vec{R}_0$, which guides the earphone housing to abut the front wall of the ear canal.

Figure 5A:
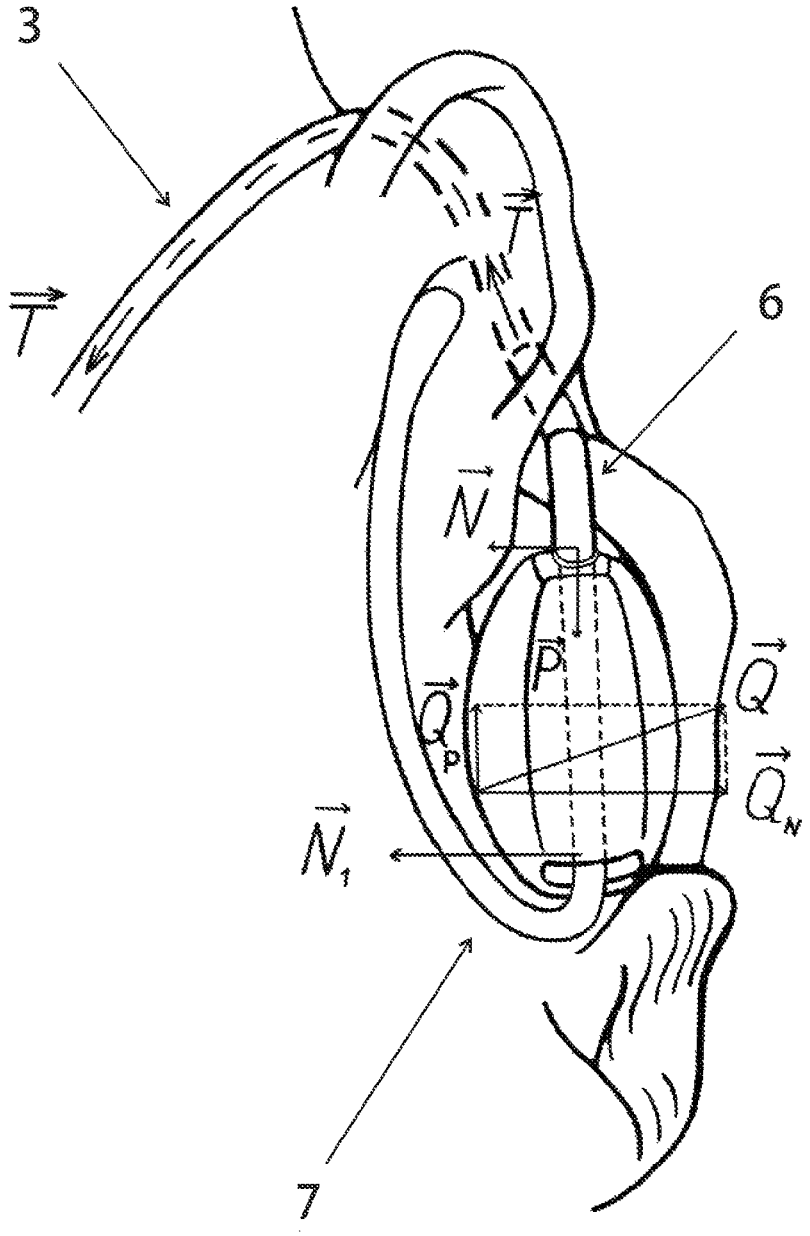
FIG. 5A and FIG. 5B show a rear and top view on the earphone in the "comfort" position displaying vector diagram of the projections of forces.

In the upper part of our earphone, the curved outer portion of the wire guide 6 forms a semi-earhook. The use of this constructive solution allows to further secure the earpiece in the ear. At the output of the earphone housing, the upper outer portion of the wire guide 6 is bent sufficiently, to perform as a lever with point of support at the front ligament of the auricle (FIG. 5A). When wearing the headset by the user, when the wire 3 goes around the top of the auricle, when the wire 3 is pulled (force T), a moment of tension force $M_T$ turns the earphone towards the auricle canal, improving fastening of the earphone in the auricle.

These conditions are optimally performed in a stereo headset, having in its composition a suboccipital node (U.S. Pat. No. 9,282,392). When using the earphones as a stereo headset, the vector sum of the forces affecting the earphones of the structure, when worn, further secures them into the ear.

In the "comfort" position, the resilient cartilage of the auricle tends to push the earphone out. The ejection force is applied perpendicular to the axis of rotation of the cylindrical joint, which leads to its rotation and loss of earphone. To counteract this force, it is effective the use of the return mechanism shaft.

Figure 5B:
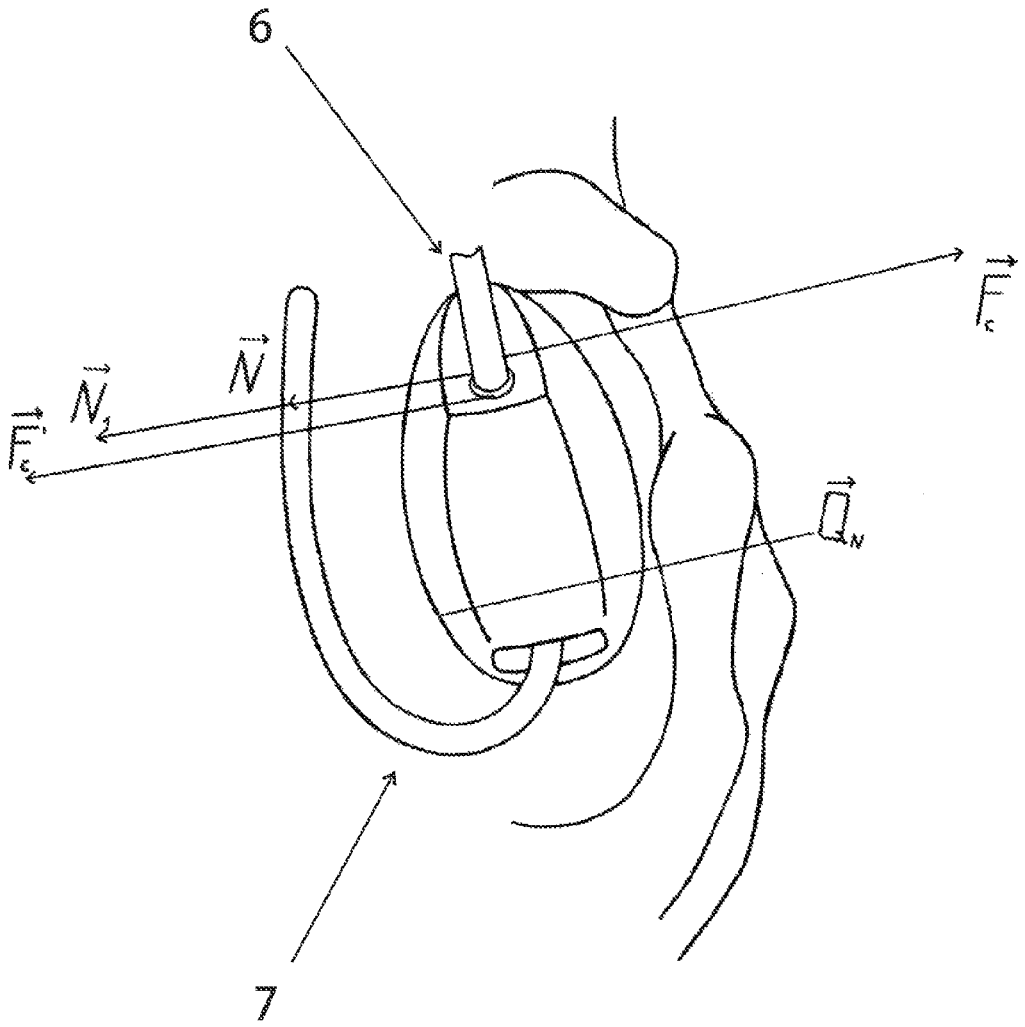

FIG. 5A and FIG. 5B are views from above and behind (ear shown in cross-section) on the headset in the "comfort" position with an indication of the vector diagram of the projections of the forces. Force $\overrightarrow{Q_N}$ (FIG. 5A) pushes the headset from the ear. It is balanced by the forces of interaction of the earphone housing with the shaft $\vec{N}$ and $\vec{N}_1$. The return mechanism creates a force couple and $\vec{F}_c$ and $\vec{F}_c$ or torque $\overrightarrow{M_c}$, which compensates for torque $\overrightarrow{Q_N}$ relative to the axis of the shaft. Along the horizontal forces, the earphone is affected by a vertical force, a diagram of which is shown in FIG. 5B. Force $\vec{P}$—is the vertical pressure force on the earpiece. It includes earphone gravity, the vertical component of the pressure force of the deformed elastic member, and the force transmitted to the bent portion of the shaft of the tension wire ($\vec{T}$—wire tension force) coming from the earpiece. Wire tension force $\vec{T}$, using the suboccipital unit, is oriented not only up, but also slightly medially. Force $\vec{N}$ and $\vec{N}_1$ are the forces of shaft reaction. Force $\vec{Q}$ arises from the resilience of tissue of the auricle from the pressure of earphone; it is perpendicular to the axis of the cylindrical joint and tends to push the earphone from of the auricle. Force $\vec{Q}$ has a vertical component $\vec{Q_P}$, compensating for force $\vec{P}$ and horizontal component $\vec{Q_N}$, compensating for force $\vec{N}$ and $\vec{N}_1$.

The problem is solved by creating an in-the-ear earphone to be worn in two positions (FIGS. 1 and 2), where the earphone includes an acoustic housing 1 including an electroacoustic transducer 8 and a sound opening 2. Also the earphone includes a wire 3 connected to the electroacoustic transducer 8, a mounting part 4 is coupled to the acoustic housing 1 through a cylindrical hinge 5 and having a rotatable wire guide 6. A bendable element 7 is connected to the mounting part 4 near an axis of rotation of the wire guide 6 and the wire 3 is connected to the wire guide 6.

The sound opening 2 is located at an end of the acoustic housing 1, opposing the axis of rotation of the wire guide 6, the bendable element 7 and an outer portion of the wire guide 6 in a first orientation (this the "comfort" position) are located substantially in the same plane as the axis of rotation of the wire guide 6 and oriented in a generally opposite direction from the axis of rotation of the wire guide 6, and the outer portion of the wire guide 6 is oriented substantially towards the sound opening 2. The outer portion of the wire guide 6 and an end of the bendable element 7 are movable through at least 50 degrees from the first orientation ("comfort" position) to a second orientation (let's call it "quality" position).

Figure 6:
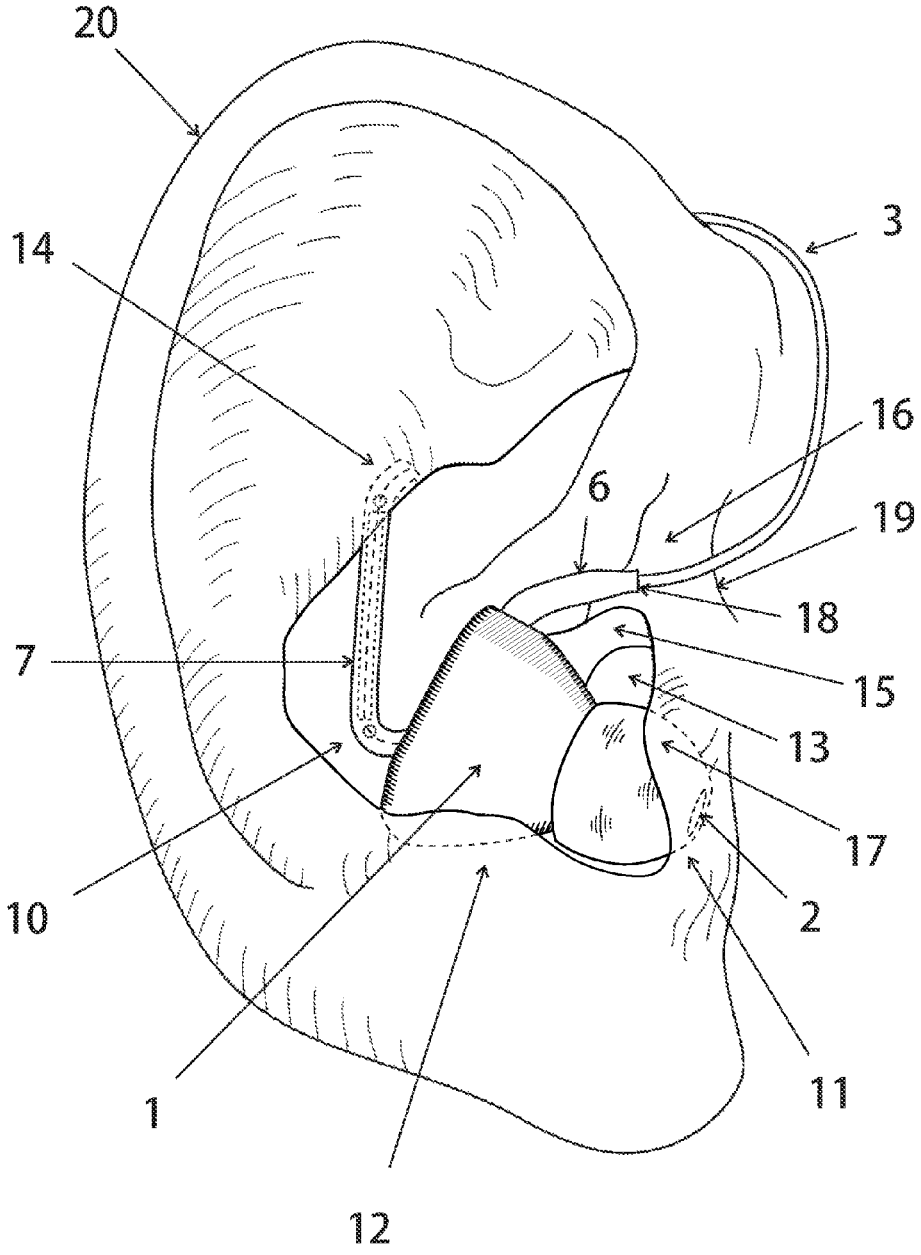
FIG. 6 and FIG. 7 show two ways of wearing the earphone by the user, according to the invention.

When the earphone is worn in the first orientation ("comfort" position) (see FIG. 6) the acoustic housing 1 is located in a cavity of the auricle 10 between a tragus 11 and an anti-tragus 12, the sound opening 2 is near an entrance of an external auditory canal 13, and the bendable element 7 abuts a lower leg of an antihelix 14.

Figure 7:
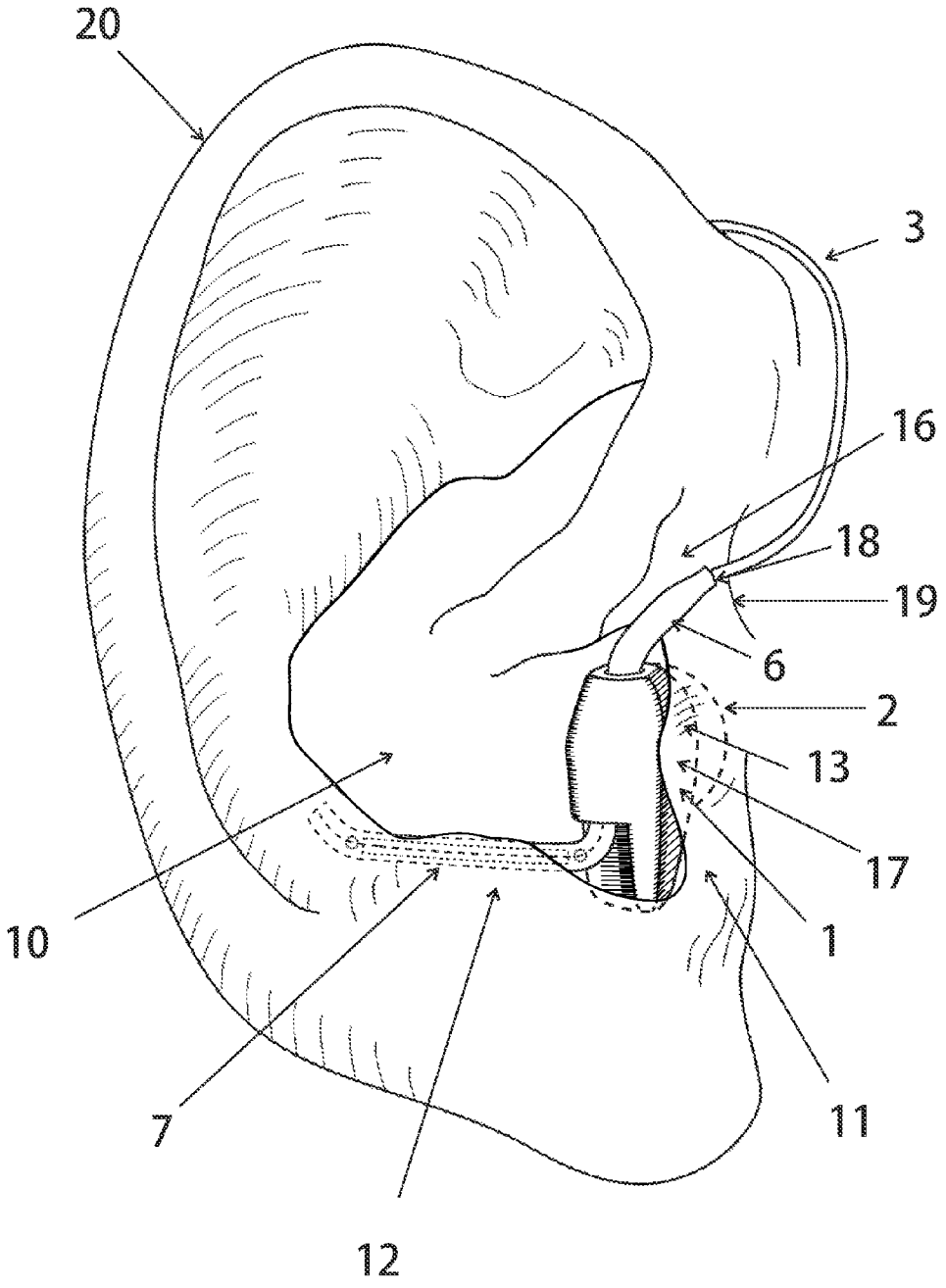

When the earphone is worn in the second orientation ("quality" position) (see FIG. 7) the acoustic housing 1 is at least partially within the external auditory canal 13, wherein the sound opening is recessed into the external auditory canal 13, and the bendable element 7 is located in the cavity of the auricle 10 behind the anti-tragus 12.

The outer portion of the wire guide 6 in the earphone (FIG. 6 and FIG. 7) has a length such that when worn in any of these two positions, the outer portion of the wire guide 6 is placed at a top clipping of an auricle 15 between a leg curl 16 and an upper-tragus tubercle 17, and a place of connection 18 of the wire 3 and the outer portion of the wire guide 6 is on a surface of a front ligament of the auricle 15, where the wire goes around an ear 14 from a top of the ear.

Thus, the technical objective is solved by creating an earphone whose shape allows the use in two positions. The "comfort" position (FIG. 6) corresponds to the position of the earphone in the auricle without penetration of the ear canal, the sound opening 2 is located near the entrance to the ear canal, and the ear canal is free. This position allows the use of earphones for a long time without overloading the ear canal, without irritating a pressure-sensitive surface of membranous cartilage (front) of the external auditory canal, and also allows the user to hear surrounding sounds.

The "quality" position (FIG. 7) corresponds to the position when most of the earphone is placed inside the external auditory canal 13, the sound opening 2 is directed toward the eardrum and is located deep inside the ear canal and the earphone housing maximum adjacent to the circumferential walls of the external auditory canal and clogs it. This earphone positions provides better passive noise reduction, reduction of the volume of air rocking by the membrane, resulting in improved sound quality.

Figure 8A:
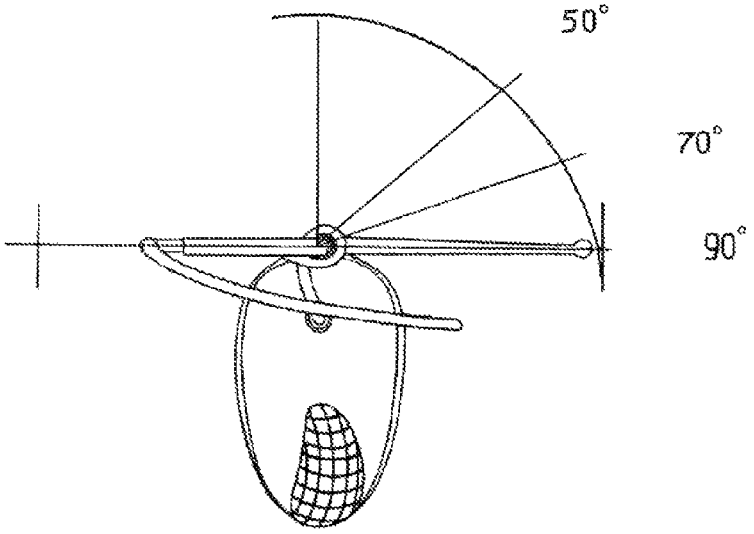
FIG. 8A and FIG. 8B show the relative positions of earphone parts when wearing earphone in two positions.
Figure 8B:
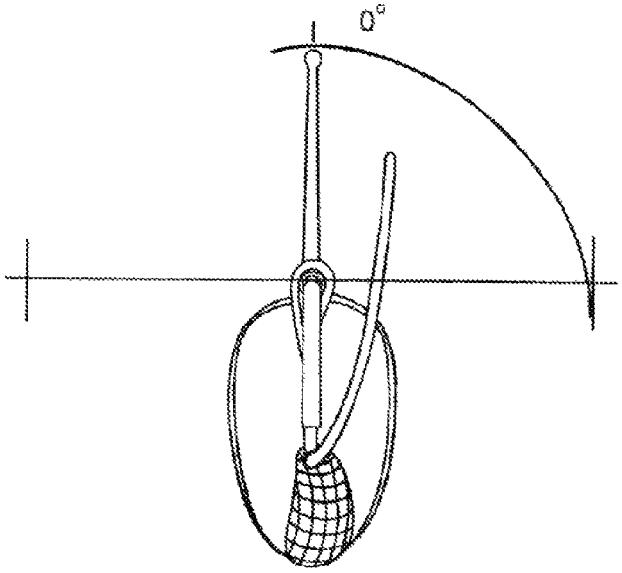

FIG. 8A and FIG. 8B are examples of relative positions of the earphone in both positions. FIG. 8A shows a top view of the earphone, where the position "quality" corresponds an angle in the range of 50 to 90 degrees, when set to "comfort", the angle is equal to or close to zero. Similarly, the change in positional relationship of parts of the earphone (FIG. 8B) when the angle is changing. The range of the angle from 50 to 90 degrees in the "quality" position allows taking into account the anatomical structure of the user's ear.

In order to prevent the ejection of the earphone by cartilaginous tissue of the ear in the position "comfort", a cylindrical hinge may be formed so as to provide sufficient rigidity for shaft rotation, preventing free rotation of the shaft from that position, wherein the wire guide 6 is oriented towards the sound opening 2.

Given that in the position "comfort", the acoustic housing 1 of the earphone with the sound opening 2 arranged at its front, can be pressed against the tragus, it is possible to use several methods of forming the sound openings to prevent it from clogging when wearing the earphone in the two positions, namely: to make the opening of an irregular shape, to offset relative to the longitudinal axis of the earphone; to increase the diameter of the opening; to place at least two sound openings on different planes; additionally set a convex large-mesh grille. Any combination of these methods is possible.

In preferred embodiments (FIG. 2), the wire guide 6 is a hollow shaft and the wire 3 is inside the hollow shaft.

In some embodiments of the earphone (FIGS. 1, 2), an outer portion of the wire guide 7 may be curved about the axis of rotation.

In various embodiments (FIG. 9), the earphone further comprises a protective grille 21, designed for protection from clogging the sound opening.

In some embodiments, the earphone further comprises a return mechanism 9, which returns wire guide to a position where the wire guide 6 is oriented towards the sound openings. The return mechanism 9 (FIG. 10) may be a cylindrical helical spring loosely wound around the wire guide 6, wherein one end of the spring is attached to the mounting part 4 and the other end of the spring is attached to one end of the guide 6.

In some embodiments, the return mechanism can be configured as a bending spring, one end of which is attached to one end of the wire guide 6 and the other end is attached to the mounting part 4 of the earphone.

In preferred embodiments of the earphone (FIG. 10) the mechanical part 5 may be arranged to rotate the wire guide 6 and the bendable element at an angle in the range of 70 to 90 degrees in either direction from a position wherein the guide 6 is oriented in the direction toward the sound opening 2.

Figure 10:
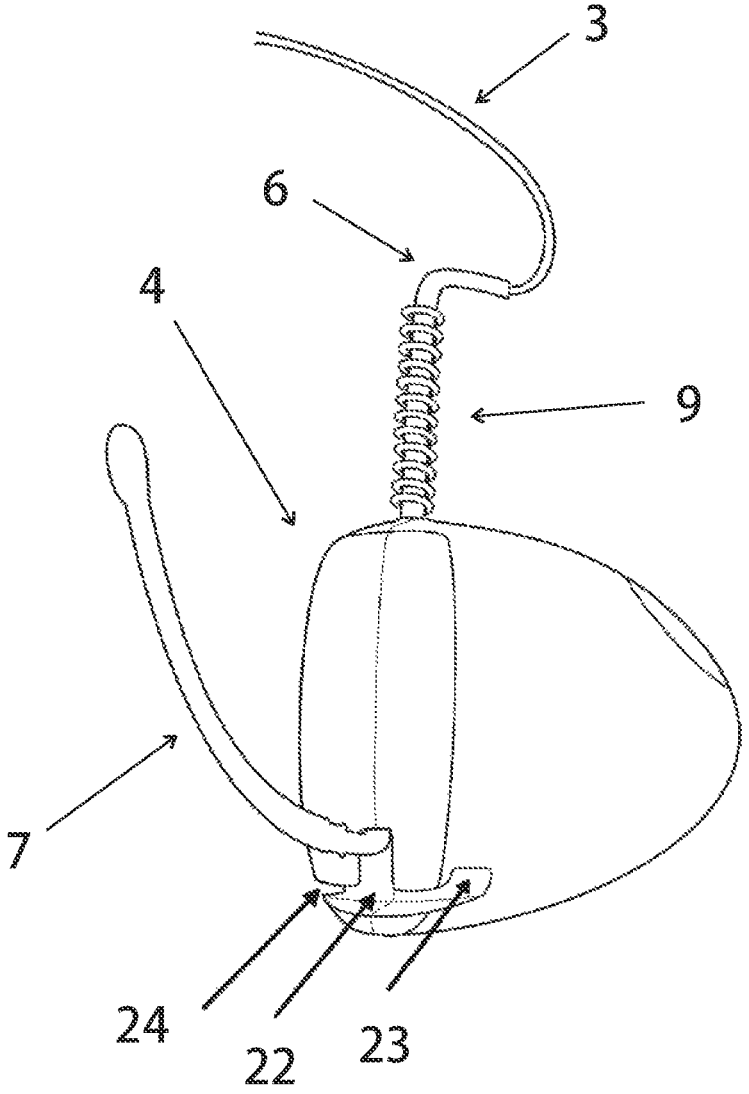
FIG. 10 shows an embodiment of the earphone for use in either user's ear.

The headphone, in the embodiment illustrated in FIG. 10, further comprises at least one latch, adapted to hold the wire guide 6 or/and the bendable element 7, at least in one of the positions. The earphone shown in FIG. 10 is intended to be worn in the either ear and comprises latches 22, 23 and 24, where the latch 22 is designed to hold the wire guide 6 when wearing earphone in either ear in the "comfort" position, the latch 23 is engaged in the "quality" position when using earphone as a right, latch 24—using earphone as a left, respectively. The wire guide 6 (FIG. 10) is adapted for longitudinal movement in the cylindrical hinge 5.

In the embodiments in which the rotation of the wire guide 6 and the bendable element is provided in any direction use of the earphone is available in either ear and exact location of the earphone is carried out by hardware methods, e.g., using a microphone and (or) accelerometers placed in the earphones.

Figure 9:
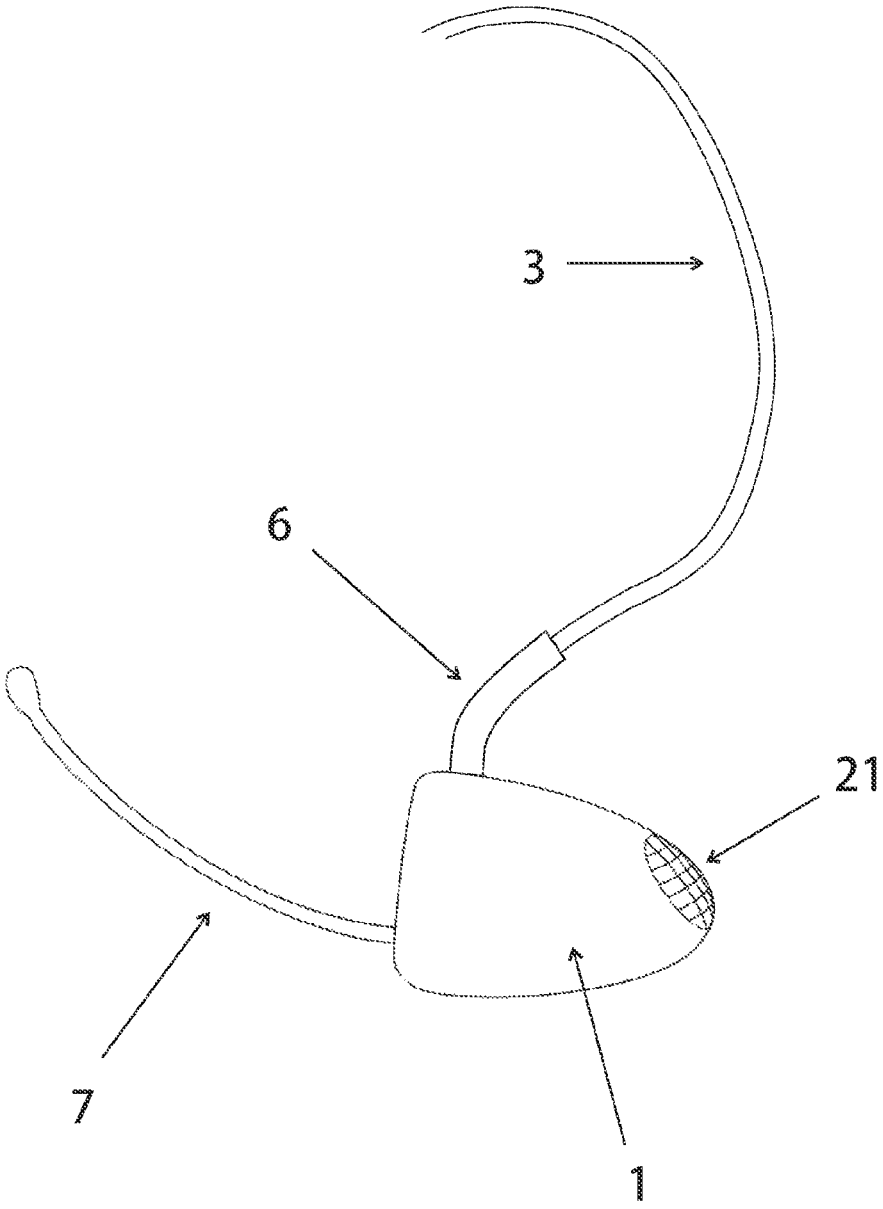
FIG. 9 shows the earphone comprising a protective grille.

FIG. 9 and FIG. 10 show the embodiments of the earphone implemented to be worn in the either ear.

In some embodiments, the earphone may further comprise an electric socket, e.g. on the section of wire between the places of fastening to the upper part of the guide 6 and the acoustic transducer 8.

Figure 11:
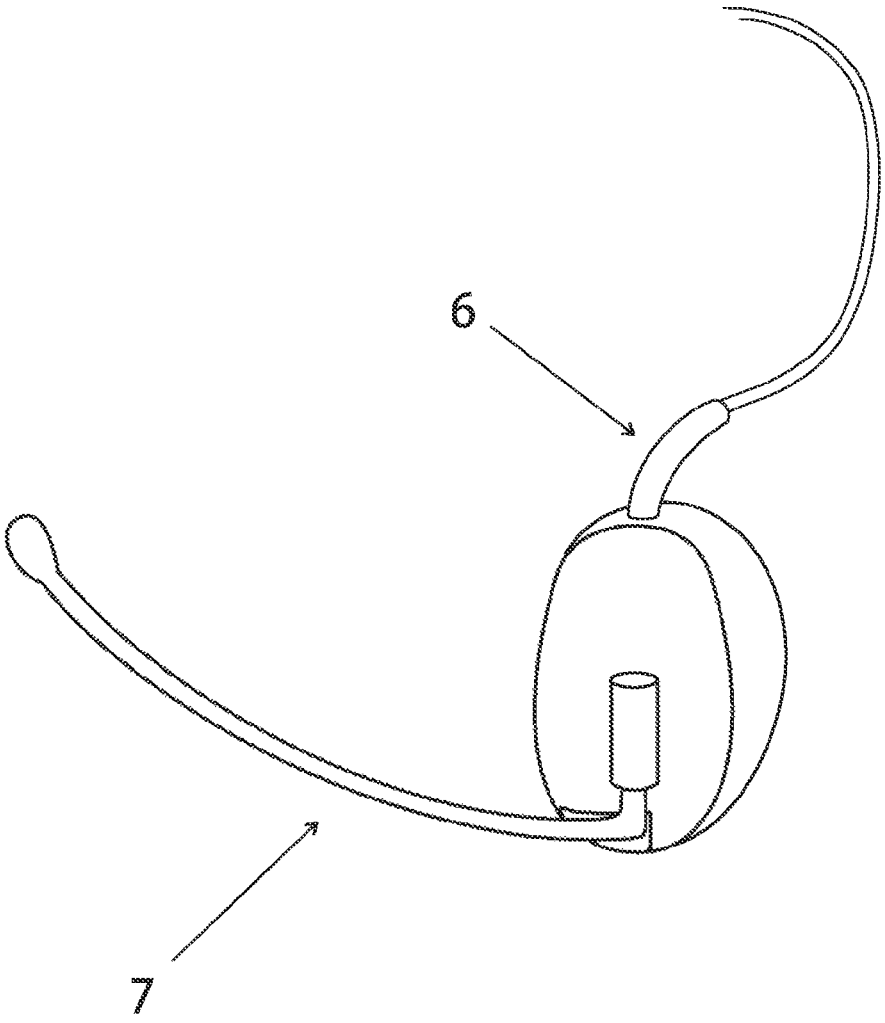
FIG. 11 shows an embodiment of the earphone with a bendable element and a wire guide moving through separately.

The bendable element 7 and the wire guide 6 (FIGS. 11, 12) may be separately movable through at least 50 degrees. This is useful for storing of headphones in the inoperative position. In some embodiments in order to provide comfortable earphone storage in the inoperative position and taking into account the anatomical structure of the user's ear (especially if its size is small), the wire guide 6 may be immovable and shortened as much as possible, but the bendable element rotation by at least 50 degrees will be provided to reach two positions when the earphone is worn in the user's ear.

In various embodiments of the earphone (FIG. 12) the wire 3 positioned within the wire guide 6 which is a hollow shaft, and the mounting part 4 may further comprise brush-commutator assembly 25, adapted to electrically connect the wire 3 with the electroacoustic transducer 8.

Figure 13:
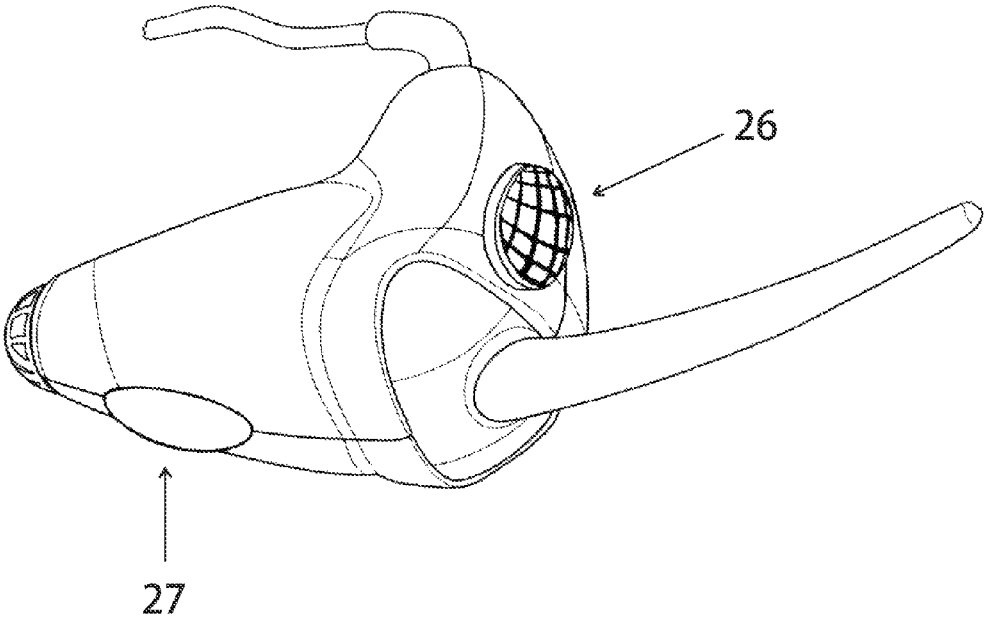
FIG. 13 shows the earphone comprising microphones.

In some embodiments (FIG. 13) the earphone may further comprise at least one microphone 26. The earphone may further comprise an air conduction microphone 27 to form a microphone array in the wearable headset or to provide an active noise-suppression when listening to music; a bone conduction microphone is designed to remove the voice carrier with minimal noise.

Figure 14:
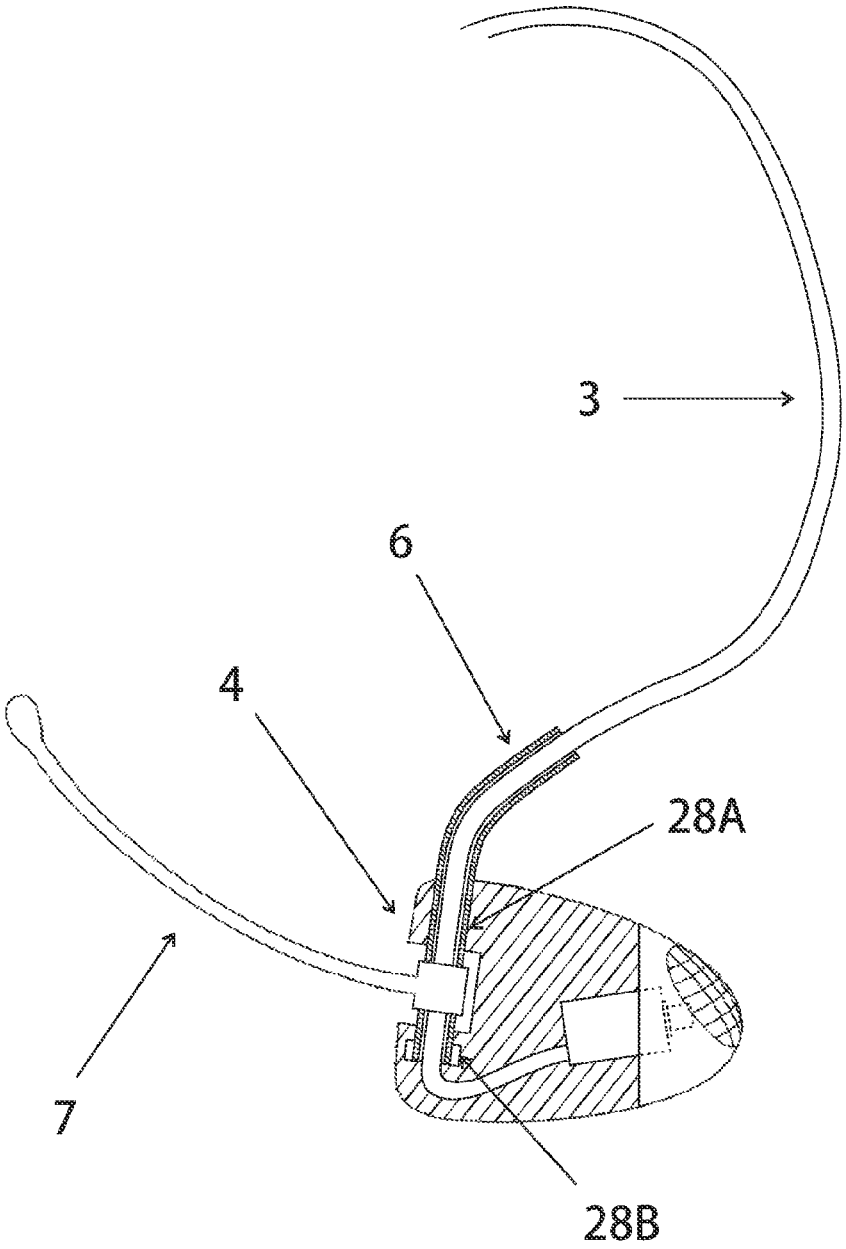
FIG. 14 shows the earphone comprising shaft bearings.

In many embodiments (FIG. 14), the mounting part 4 may include at least two shaft bearings 28A, 28B and the first end of the bendable element 7 may be connected to the mounting part 4 between the shaft bearings 28A and 28B. FIG. 14 shows the earphone where the bendable element 7 is attached directly to the wire guide 6 between the shaft bearings.

In embodiments, the bendable element 7 may be detachable. This allows using a set of replaceable bendable elements of different lengths and rigidity to meet a user's requirements for comfort wearing and fixing of the earphone. The bendable member 7 may be made of rubber, a spiral spring, a combination of these materials, or be an integral part of the cover.

The auricles may have different sizes and the location of the bendable element differs in two positions when an earphone is worn by user. In the "comfort" position the bendable element 7 abuts a lower leg of an antihelix, but in "quality" position the bendable element 7 does not reach the lower leg of the antihelix, its length is excessive for placement in the auricle and the outer end of the bendable element 7 extends beyond the auricle and does not hold the headset in the auricle. Also, it impacts negatively the appearance of a user. To prevent this, in some embodiments the length of the bendable element 7 may be shortened, a rigid rod may be inserted in the middle portion of the bendable element 7, the point of attachment of the bendable element to the earphone's housing or to the rotary shaft should be located as high as possible, close to the outer portion of the wire guide 6.

Wherein worn by user in the "comfort" position, the bendable element 7 does not repeat the bending of the low cavity of the auricle, but it is bent almost vertically upwards, abutting the lower leg of the antihelix, the outer soft portion of the bendable element 7 is located behind the lower leg of the antihelix, securely holding the earphone in the auricle. When worn by user in the "quality" position the shortened rigid bendable element 7 fits entirely in the auricle.

Figure 15:
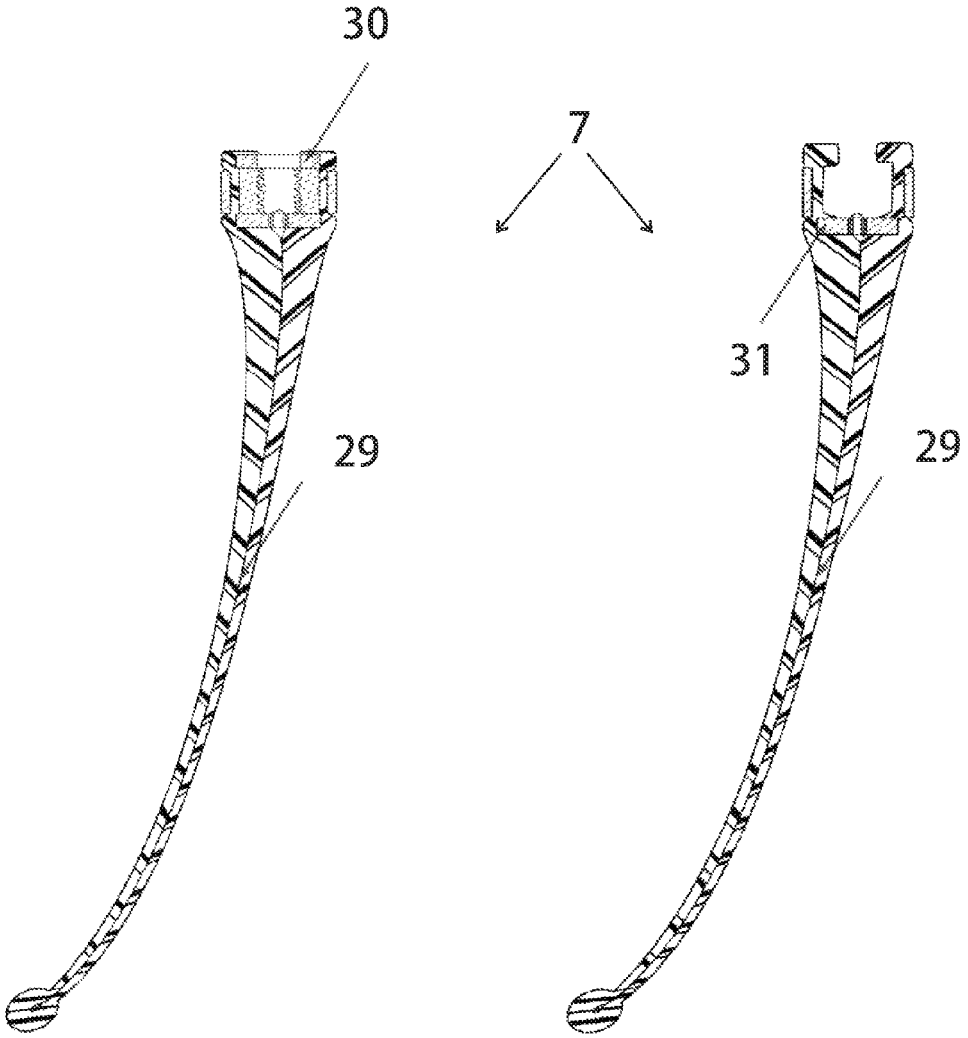
FIG. 15 shows embodiments of the flexible element.

In various embodiments (FIG. 15), the bendable element 7 further includes a longitudinal rigid thread 29, secured within the bendable element 7, and the bendable element 7 may be arranged to adjust its length. It may be advisable to insert a sturdy thread 29 longitudinally inside the bendable element 7, where the thread 29 will prevent breakage of the bendable element 7 in the case of stretching the bendable element 7 of earphone from deep intra-canal position. The thread 29 is fixed in the bendable element 7 by a washer 30 or secured to the threaded sleeve 31.

In some embodiments of the earphone, the bendable element 7 is formed as a loop.

Figure 16:
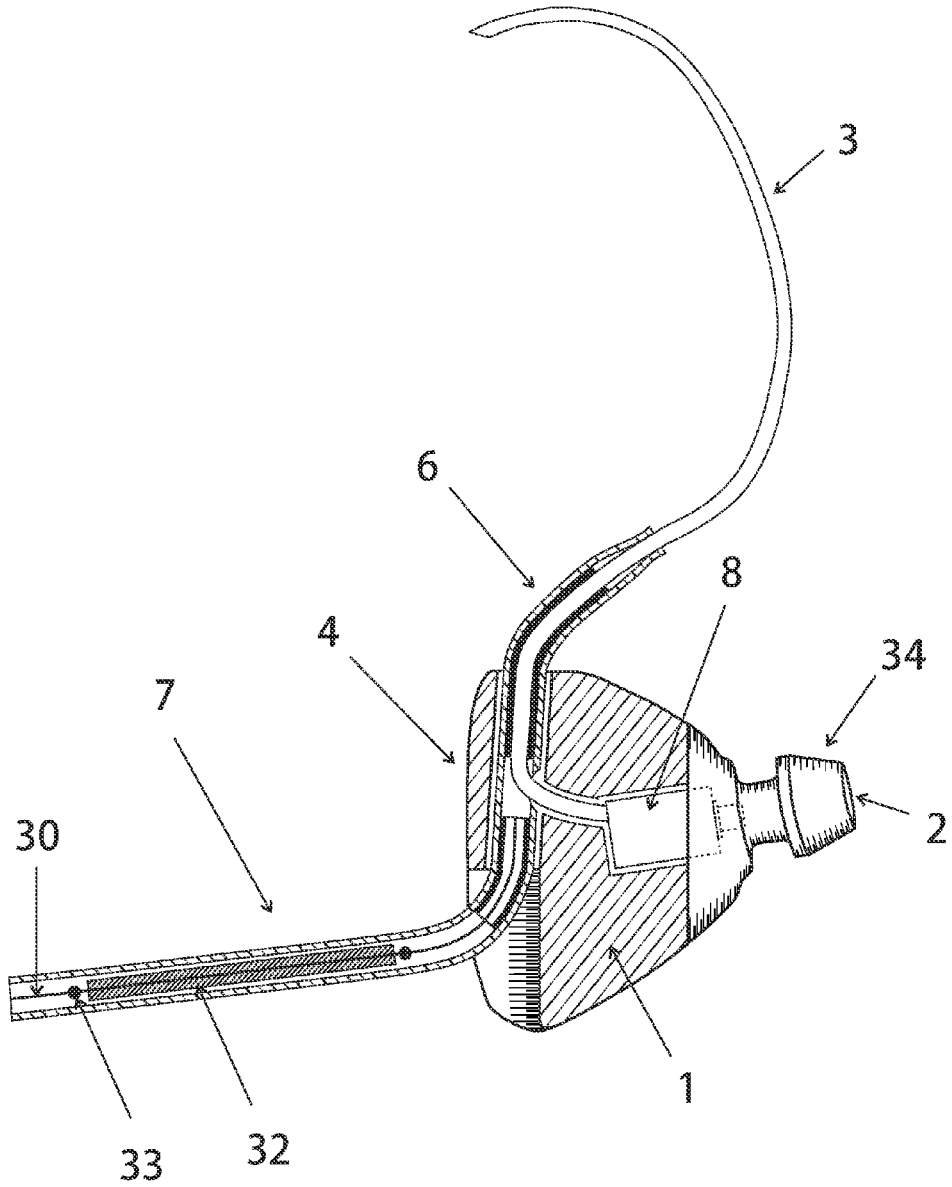
FIG. 16 and FIG. 17 show a sectional view of the earphone in various embodiments showing the main functional elements of the invention.
Figure 17:
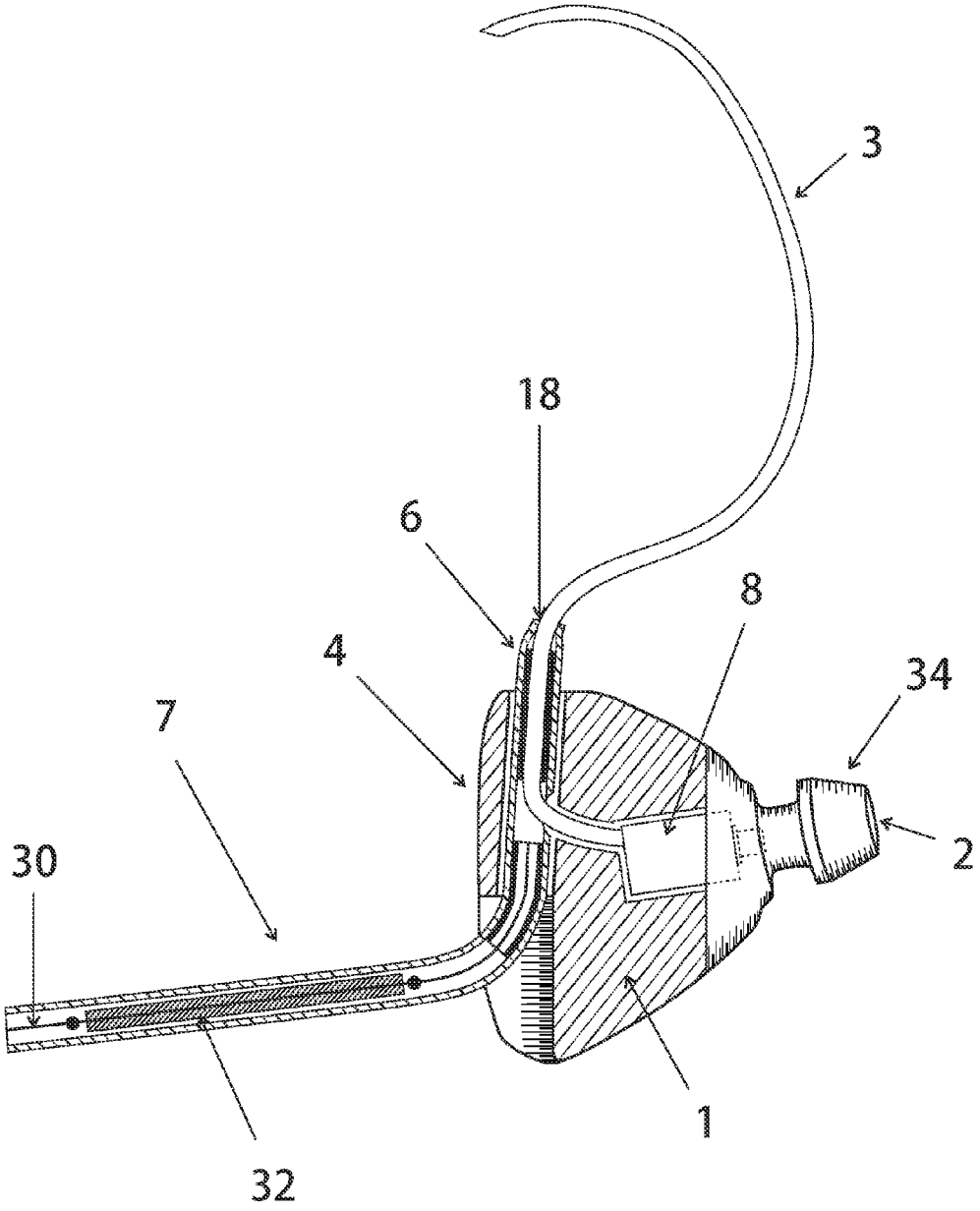

The FIG. 16 and FIG. 17 show the earphones wherein a central portion 32 of the bendable element 7 may be more rigid than end portions of the bendable element 7. The thread 29 may include a knot 33 for better fixation (FIG. 16).

In some embodiments (FIGS. 16, 17) the earphone may further include an embouchure and the housing 1 may further provide with fasteners 34 for it.

Also the technical objective is solved by creating an in-the-ear earphone (FIG. 17) to be worn in two positions, comprises an acoustic housing 1 including an electroacoustic transducer 8 and a sound opening 2. A wire 3 is connected to the electroacoustic transducer 8, a mounting part 4 coupled to the acoustic housing 1 and having a wire guide 6, wherein the wire 3 is coupled to the wire guide 6. A bendable element 7 has a first end connected to the mounting part 4 and the bendable element 7 is movable through at least 50 degrees.

In a first orientation ("comfort" position) the bendable element 7, the wire guide 6 and the sound opening 2 are generally in a common plane, and are configured such that when worn by a user, the acoustic housing 1 is in a cavity of a auricle between a tragus and an anti-tragus, the sound opening 2 is near an entrance of an external auditory canal, and the bendable element 7 abuts a lower leg of an antihelix.

In a second orientation ("quality" position) that is at least 50 degrees (more preferably, at least 70 degrees, more preferably still, about 90 degrees) rotated from the first orientation, the bendable element 7, the acoustic housing 1 is at least partially within the external auditory canal, wherein the sound opening 2 is recessed into the external auditory canal, and the bendable element 7 is located in the cavity of the auricle behind the anti-tragus.

The wire guide 6 is configured to be placed at a top clipping of the auricle between a leg curl and an upper-tragus tubercle in either the first or second orientation, wherein a coupling 18 of the wire and the wire guide is on a surface of a front ligament of the auricle, and the wire 3 goes around an ear from a top of the ear.

Figure 12:
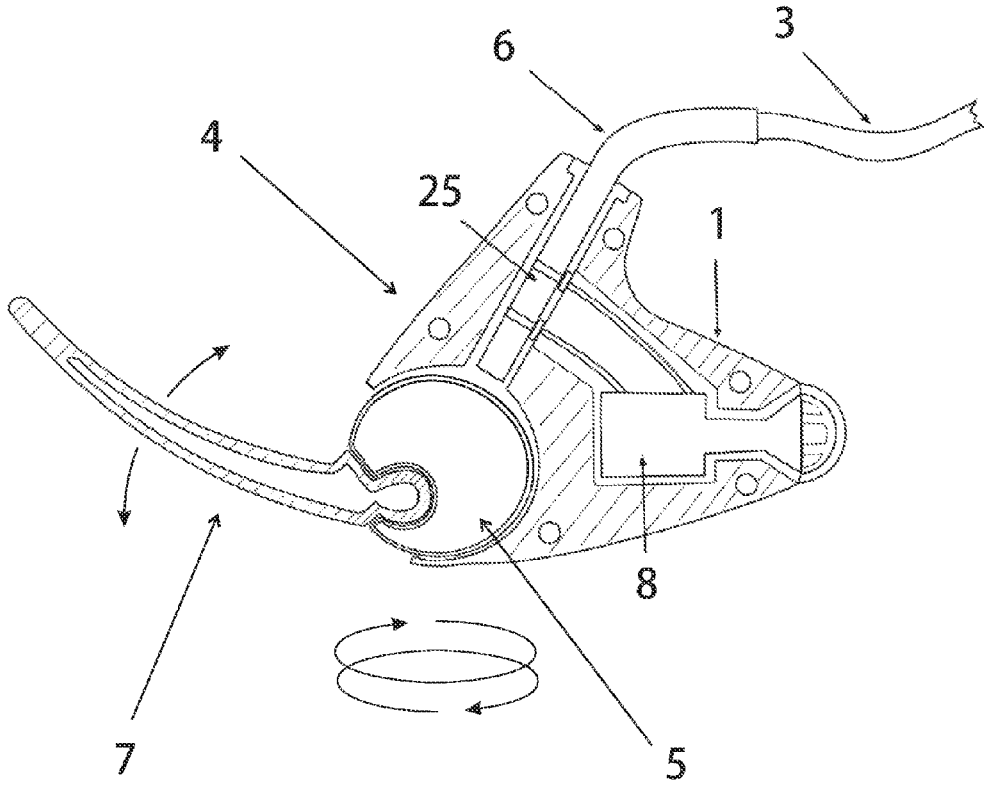
FIG. 12 shows the earphone comprising a brush-collector mechanism.
Figure 18:
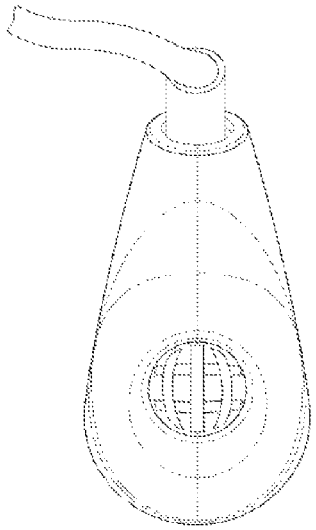
FIG. 18, FIG. 19 and FIG. 20 show the earphone in one embodiment of the invention.
Figure 19:
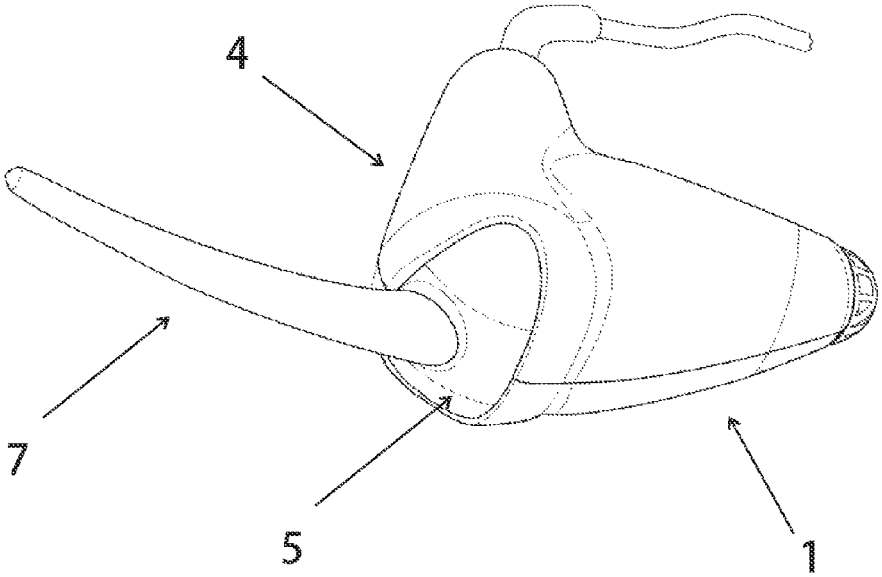
Figure 20:
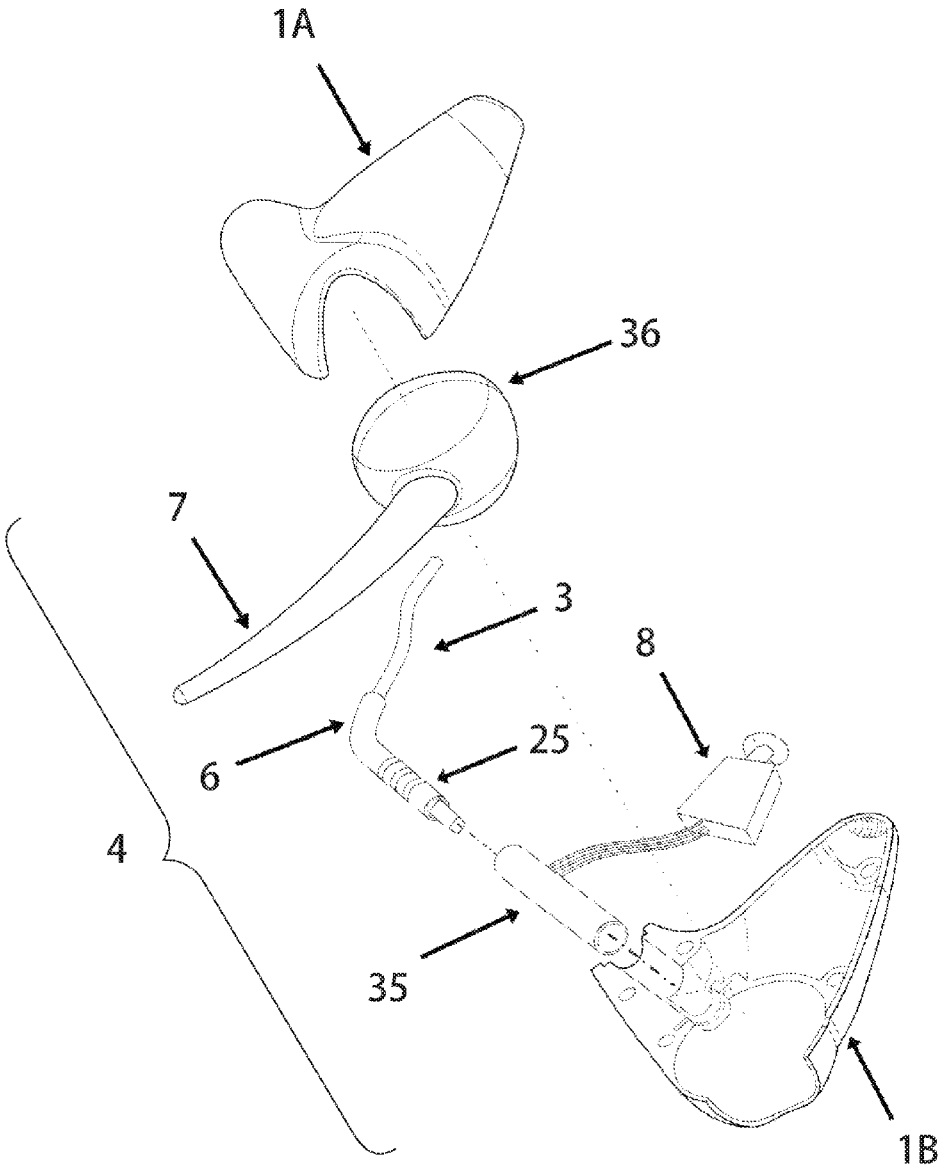

In one embodiment of the earphone (FIGS. 18, 19 and 20) connection of the mounting part 4 with the bendable element 7 is made in the form of a ball, rotating in a cavity of the hinge 5. The design features of the earphone are presented in FIG. 18. The acoustic housing 1 is made of two parts 1A and 1B. The wire guide 6 is a hollow shaft, which is curved at one end and is attached to the mounting part 4 by means of a sleeve 35. On the sleeve 35 and the guide 6 there is a brush-collector mechanism 25 connecting the wire 3 with electro-acoustic transducer 8. In this embodiment, the use of electro-acoustic transducer 8 is provided with a balanced armature, reducing the overall size and leaving room for placement of microphones in the housing 1 of the earphone or the cavity of the rotating sphere. The flexible element 7 comprises a spherical socket 36, firmly placed in the respective cavity of the housing 1. The bendable element 7 may change position relative to the acoustic housing in several planes, for example, in the horizontal plane and in the vertical plane (FIG. 12).

In some embodiments, the earphone may further comprise a soft cover designed to fit over the acoustic part 1 of the earphone, and in some embodiments, at least partially, on the bendable element 7.

The cover has at least one opening for the sound output and located opposite the sound opening 8 when wearing the cover. The earphone may be provided with a set of covers of different sizes, textures and colors, using which the user adjusts the size, shape and color of the earphone. When using a microphone, additionally placed on the earphone, the soft cover can serve as an additional windscreen to the microphone, wherein the cover may at least partially serve as a bendable element of the earphone.

When creating earphones, it is best to make the earphones maximally flat and the least hook-shaped, since when using earphones if the device is worn on the body, being removed from the ear, the earphones are positioned on the body under the clothing. Furthermore, some wearable devices provide for the winding of wire of the earphones followed by placing the earphones in a special cavity or pocket of the worn device. The flatter the earphones, the more comfortable will be wearing them on the body in a variety of devices of wearable electronics.

Having thus described a preferred embodiment, it should be apparent to those skilled in the art that certain advantages of the described method and system have been achieved. It should also be appreciated that various modifications, adaptations, and alternative embodiments thereof may be made within the scope and spirit of the present invention. The invention is further defined by the following claims.

What is claimed is:

1. An in-the-ear earphone to be worn in two positions, comprising:

an acoustic housing including at least one electroacoustic transducer and at least one sound opening, a wire connected to the electroacoustic transducer, a mounting part coupled to the acoustic housing through a cylindrical hinge and having a rotatable wire guide, a bendable element having a first end connected to the mounting part near an axis of rotation of the wire guide, wherein the wire is connected to the wire guide, wherein the sound opening is located at an end of the acoustic housing, opposing the axis of rotation of the wire guide, wherein the bendable element and an outer portion of the wire guide in a first orientation are located substantially in the same plane as the axis of rotation of the wire guide and oriented in a generally opposite direction from the axis of rotation of the wire guide, and the outer portion of the wire guide is oriented substantially towards the sound opening, and wherein the outer portion of the wire guide and a second end of the bendable element are movable through at least 50 degrees from the first orientation to a second orientation, wherein when the earphone is worn in the first orientation, the acoustic housing is located in a cavity of the auricle between a tragus and an anti-tragus, the sound opening is near an entrance of an external auditory canal, and the bendable element abuts a lower leg of an antihelix, wherein the acoustic housing when worn in the second orientation is at least partially within the external auditory canal, wherein the sound opening is recessed into the external auditory canal, and the bendable element is located in the cavity of the auricle behind the anti-tragus, the outer portion of the wire guide, when worn in either the first or second orientation, is placed at a top clipping of an auricle between a leg curl and an upper-tragus tubercle, wherein, a place of connection of the wire and the outer portion of the wire guide is on a surface of a front ligament of the auricle, wherein the wire goes around an ear from a top of the ear.

2. The earphone of claim 1, wherein the wire guide is a hollow shaft and the wire is inside the hollow shaft.

3. The earphone of claim 1, wherein the earphone further comprises a grille that protects the sound opening.

4. The earphone of claim 1, wherein the earphone further comprises a return mechanism that returns the wire guide to the first orientation from the second orientation.

5. The earphone of claim 1, wherein the mounting part rotates the wire guide by at least 50 degrees in either direction from the first orientation.

6. The earphone of claim 5, wherein the earphone can be worn in either ear.

7. The earphone of claim 1, wherein the earphone further comprises an electric socket.

8. The earphone of claim 1, wherein the wire guide is adapted for longitudinal movement in the cylindrical hinge.

9. The earphone of claim 1, wherein the earphone further comprises an embouchure, and the acoustic housing includes fasteners for the embouchure.

10. The earphone of claim 1, wherein the bendable element is detachable.

11. The earphone of claim 1, wherein the bendable element further comprises a longitudinal thread, which is secured within the bendable element.

12. The earphone of claim 1, wherein the bendable element has an adjustable length.

13. The earphone of claim 1, wherein the bendable element is formed as a loop.

14. The earphone of claim 1, wherein the earphone further comprises at least one latch, adapted to hold the wire guide.

15. The earphone of claim 1, wherein the earphone further comprises at least one microphone.

16. The earphone of claim 1, wherein a central portion of the bendable element is more rigid than end portions of the bendable element.

17. The earphone of claim 1, wherein the mounting part includes at least two shaft bearings and the first end of the bendable element is connected to the mounting part between the shaft bearings.

18. The earphone of claim 1, wherein the first end of the bendable element is connected to the wire guide.

19. The earphone of claim 1, wherein the bendable element and the wire guide are separately movable through at least 50 degrees.

20. An in-the-ear earphone to be worn in two positions, comprising:

an acoustic housing comprising an electroacoustic transducer and a sound opening, a wire connected to the electroacoustic transducer, a mounting part coupled to the acoustic housing and having a wire guide, wherein the wire is coupled to the wire guide, a bendable element having a first end connected to the mounting part;

wherein the bendable element is movable through at least 50 degrees;

wherein the bendable element, the wire guide and the sound opening in a first orientation are generally in a common plane, and are configured such that when worn by a user, the acoustic housing is in a cavity of a auricle between a tragus and an anti-tragus, the sound opening is near an entrance of an external auditory canal, and the bendable element abuts a lower leg of an antihelix;

wherein the bendable element in a second orientation is at least 50 degrees from the first orientation, the acoustic housing is at least partially within the external auditory canal, wherein the sound opening is recessed into the external auditory canal, and the bendable element is located in the cavity of the auricle behind the anti-tragus;

wherein the wire guide is configured to be placed at a top clipping of the auricle between a leg curl and an upper-tragus tubercle in either the first or second orientation, wherein a coupling of the wire and the wire guide is on a surface of a front ligament of the auricle, and wherein the wire goes around an ear from a top of the ear.

21. The earphone of claim 20, wherein the wire guide is a hollow shaft and the wire is inside the hollow shaft.

22. The earphone of claim 20, wherein the earphone further comprises a grille which protects the sound opening.

23. The earphone of claim 20, wherein the at least one end of the wire guide is curved.

24. The earphone of claim 20, wherein the earphone can be worn in either ear.

25. The earphone of claim 20, wherein the earphone further comprises an electric socket.

26. The earphone of claim 20, wherein the earphone further comprises an embouchure, and the acoustic housing includes fasteners for the embouchure.

27. The earphone of claim 20, wherein the bendable element is detachable.

28. The earphone of claim 20, wherein the bendable element further comprises a longitudinal thread, which is secured within the bendable element.

29. The earphone of claim 20, wherein the bendable element has an adjustable length.

30. The earphone of claim 20, wherein the bendable element is formed as a loop.

31. The earphone of claim 20, wherein the earphone further comprises at least one latch, adapted to hold the bendable element.

32. The earphone of claim 20, wherein the earphone further comprises at least one microphone.

33. The earphone of claim 20, wherein a central portion of the bendable element is more rigid than end portions of the bendable element.

34. A method of wearing an in-ear earphone comprising:

with an acoustic housing comprising at least one electroacoustic transducer and at least one sound opening, a wire electrically connected to the electroacoustic transducer, a mounting part coupled to the acoustic housing and having a wire guide, wherein the wire is coupled to the wire guide, a bendable element connected to the mounting part, wherein the bendable element is movable through at least 50 degrees, to arrange the earphone in a first orientation, a user puts the acoustic housing in a cavity of an auricle between a tragus and an anti-tragus, places the sound opening near an entrance of an external auditory canal, and abuts a second end of the bendable element to a lower leg of an antihelix, such that the bendable element, the wire guide and the sound opening are located substantially in a common plane, to arrange the earphone in a second orientation, the user moves an end of the bendable element through at least 50 degrees, puts the acoustic housing inside the external auditory canal, and arranges the sound opening inside of the external auditory canal, wherein, when the earphone is worn in either the first or second orientation, the wire guide is located at a top clipping of the auricle between a leg curl and an upper-tragus tubercle, a coupling of the wire and the wire guide is located on a surface of a front ligament of the auricle, and the wire is placed around an ear from a top of the ear.

* * * * *